United States Patent [19]

Stumpf

[11] Patent Number: 4,572,495

[45] Date of Patent: Feb. 25, 1986

[54] APPARATUS FOR LAYING WEB MATERIAL

[76] Inventor: Gunter O. Stumpf, Ostendstrasse 13, D-7432 Urach, Fed. Rep. of Germany

[21] Appl. No.: 728,263

[22] Filed: Apr. 29, 1985

Related U.S. Application Data

[63] Continuation-in-part of Ser. No. 412,262, Aug. 27, 1982, Pat. No. 4,516,760.

[30] Foreign Application Priority Data

Sep. 23, 1981 [DE] Fed. Rep. of Germany ..... 3137876

[51] Int. Cl.[4] ..... B65H 29/46

[52] U.S. Cl. ..... 270/31

[58] Field of Search ..... 270/30, 31

[56] References Cited

U.S. PATENT DOCUMENTS 4,339,118 7/1982 Burton et al. ..... 270/31

FOREIGN PATENT DOCUMENTS 937511 9/1963 United Kingdom ..... 270/31

*Primary Examiner*—E. H. Eickholt

*Attorney, Agent, or Firm*—Scully, Scott, Murphy & Presser

[57] ABSTRACT

The apparatus comprises a laying carriage which travels over a laying surface to deposit web material on the surface. The web material falls as a suspended web. Behind the suspended and descending web there is at least one pivoting air nozzle which directs a jet of air at the suspended web to avoid creasing the material as it is laid. The pivoting air nozzle fans the jet of air across the downwardly descending web as it falls. Means are provided for varying the speed of the pivoting nozzle as the speed of the laying carriage varies.

23 Claims, 4 Drawing Figures

APPARATUS FOR LAYING WEB MATERIAL

CROSS REFERENCE TO RELATED APPLICATION

This application is a continuation-in-part of my prior pending application U.S. Ser. No. 412,262 filed Aug. 27, 1982, now U.S. Pat. No. 4,516,760.

TECHNICAL FIELD OF THE INVENTION

This invention relates to apparatus for laying web material, particularly, although not exclusively, material of loose consistency such as delicate fabrics.

BACKGROUND OF THE INVENTION AND PRIOR ART

It frequently happens when laying web material of loose consistency that undesirable folds are formed in the material. This is particularly so in the case of difficult materials like nylon, knitwear, jersey, plush and other delicate fabrics. The folds run not only in the direction of travel of the laying carriage which deposits the material but also at right angles thereto. In order to remove this disadvantage of fold formation, it has already been suggested in German Offenlegungsschrift No. 28 38 097 that at least one air nozzle, constructed and arranged in a special way, be provided on the laying carriage.

With a known air nozzle of such a kind, whose blowing direction can be adjusted only in a limited way and is otherwise arranged in a fixed manner on the laying carriage, air is blown against the web material shortly before or after it reaches the laying surface. This can largely avoid the formation of folds, but there is no absolutely sure guarantee that folds, more particularly in the region of the edge of the web, no longer actually exist at any points of the laid-out web material. Folds of such a kind can not be tolerated, for example, in machines for laying material which cooperate with a material cutting apparatus, since the folds would lead to faulty cuts and consequently to defective goods.

SUMMARY OF THE INVENTION

According to the present invention there is provided apparatus for laying web material on a laying surface, the apparatus comprising a laying carriage which is movable over the laying surface to deposit the material on the laying surface, the material falling as a suspended web from the laying carriage to the laying surface, the apparatus further comprising at lease one air nozzle mounted on the laying carriage for directing air at the web material, the nozzle being deposed behind the suspended web with respect to the travel direction of the laying carriage during deposition of the material, and being mounted at the free end of a flexible air supply line.

By using apparatus in accordance with the present invention, it is possible to a greater extent that before to reach a situation where the formation of folds is prevented entirely even at comparatively high speeds of the laying carriage. Furthermore, it is possible to reach a situation where folds, which have nevertheless developed in the web material which is laid out, are smoothed out.

The advantages achieved by the invention arise from the arrangement of the air nozzle at the free end of the flexible air supply line. With this construction, the occurrence of folds is reduced, and any folds which do form in the uppermost layer of material can be detected and quickly blown away. As the intensity of the blowing effect of the nozzle can be increased in a simple way by increasing the flow rate of air to the air nozzle, it is also possible to avoid the formation of folds or to eliminate any folds which do form when speeds of the laying carriage are comparatively high. Furthermore the flexible compressed-air supply line permits adjustment of each desired blowing direction of the air nozzle, that is either of a constant blowing direction or of blowing directions which alter constantly.

DETAILED DESCRIPTION OF PREFERRED EMBODIMENTS

Figure 1:
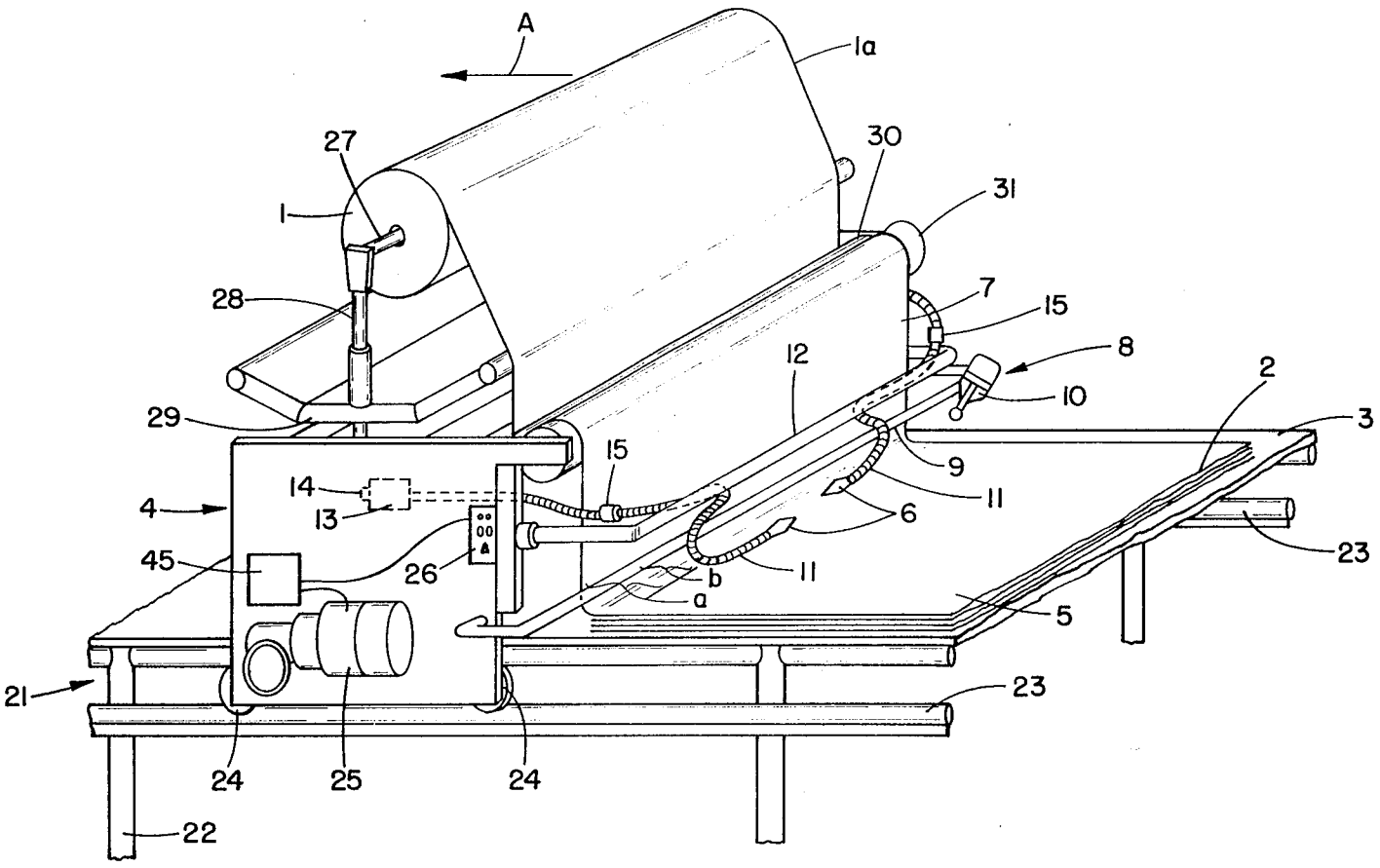
FIG. 1 is a general view of fabric laying apparatus.

The fabric laying apparatus comprises a laying carriage 4 which carries a supply of material in the form of a roll 1 and which can be moved backwards and forwards over a laying area 3 which receives sheets 2 of the material.

The laying area 3 comprises the surface of a table 21 having a support 22 at each side of which is provided a roller rail 23 for rollers 24 of the laying carriage 4. The laying carriage 4 can be moved backwards and forwards along the roller rails 23 by hand or by means of a driving motor 25. A control panel 26 and a speed regulating unit 45 is mounted on the carriage 4 to regulate the speed of motor 25, and the nozzle drive means, as will be hereinafter described in detail. The laying carriage 4 has two roll carriers 28, arranged on a support 29, of which only one is visible in FIG. 1. The roll carriers 28 support a roll spindle 27 which extends through the roll 1 of material 2. The web 1*a* of material to be unwould extends downwards from the roll 1, over a guide roller 30 and then upwardly and over a feed roller 31, from which the web falls as a suspended web 7.

On the laying carriage 4 there is at least one air nozzle 6, which acts on the top layer 5 of material on the surface 3. The nozzle 6 directs air from above and generally at right angles to the direction of travel A of the carriage 4. The nozzle 6 is a distance behind the suspended web with respect to the direction of travel A during deposition of material 7. In the embodiment shown in FIGS. 1 and 2 there are two air nozzles 6, while the embodiment shown in FIG. 3 only has one air nozzle 6. The air nozzles 6 are elongate.

The distance a in FIG. 1 of both air nozzles 6 from the suspended web 7 is advantageously approximately 40 to 60 cm. In so far as the laying carriage 4 of FIGS. 1 to 3 has a cross cutter 8 for separating the deposited layer 5 from the suspended web 7, the distance b of at least one air nozzle 6 from the cross cutter 8 advantageously amounts to approximately 20 to 60 cm, preferably to approximately 30 to 50 cm. In so far as the cross cutter 8 consists of a transverse track 9 mounted on the laying carriage 4, for guiding a cutter 10 in backward-and-forward movement, preferably driven by an electric motor, the distance b of at least one air nozzle 6 from the track 9 advantageously also amounts to approximately 20 to 60 cm, preferably to approximately 30 to 50 cm. The cooperation between the air nozzles 6 and the cutter 8 results in each layer of material lying substantially exactly over the previous layer, so that downturned edges or corners do not occur.

More particularly for the purposes of fine adjustment, at least one of the air nozzles 6 is mounted on the laying carriage 4 with an adjustable blowing direction. It is advantageous for at least one of the air nozzles 6 to be adjustable in its distance from the suspended web 7 and/or in tis height and/or in the direction at right angles to the direction of travel A. Each air nozzle 6 is provided at the free. end of a flexible compressed air line 11 which is held in position, in a manner not represented, by means of supporting or suspension parts like struts, supports, ropes or threads or the like, which are connected with the laying carriage 4, or which consists of a material which makes it possible for it to be flexible yet self-supporting so that it will remain independently in a position into which it is bent. For examble the line 11 may comprise a segmental or transversely grooved tube as indicated in FIG. 1 which renders possible a universal adjustment of the air nozzle.

The compressed-air supply line 11 is arranged on a crossbar 12 of the laying carriage disposed behind the suspended web 7 with respect to the travel direction A. The height of the crossbar 12 and/or the distance of the crossbar 12 from the suspended web 7 may be adjustable. The crossbar 12 is advantageously made of a light material for example plastic or aluminium, in order to keep the weight of the laying carriage 4 as low as possible.

As is indicated in FIG. 1, the air nozzles 6 are connected with a compressed-air source 13, mounted on the laying carriage 4, for example, a ring compressor. The compressed-air source is provided with a control member or handle 14 for controlling the flowrate of compressed air.

Figure 3:
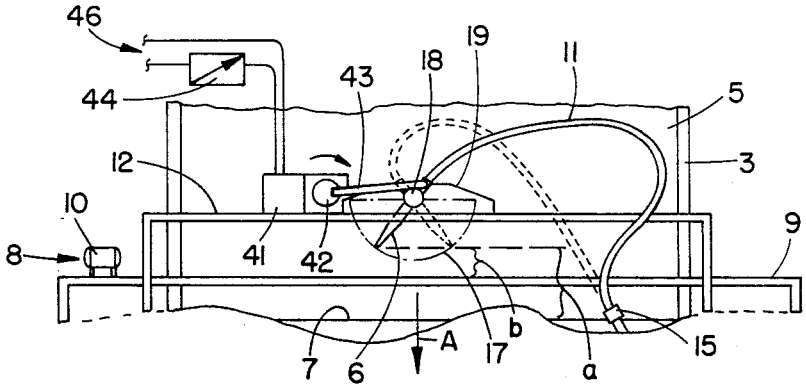
FIG. 3 corresponds to FIG. 2 but shows an alternative construction.
Figure 4:
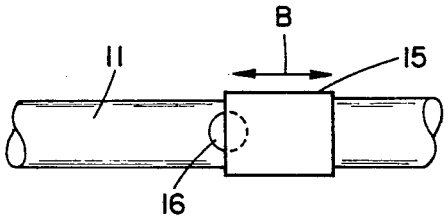
FIG. 4 is a view on an enlarged scale of a detail of the apparatus.

As FIGS. 1, 3 and 4 show, each air nozzle 6 has an adjusting element 15 which regulates the intensity of the issuing compressed air and which is provided in the compressed-air supply line 11. As shown in FIG. 4, the adjusting element 15 comprises an adjusting sleeve which surrounds the compressed-air supply line 11, and can be moved axially backwards and forwards as indicated by the double arrow B. An aperture 16 is provided in the wall of the compressed-air supply line which can be closed or fully or partly open according to the axial position of the sleeve. The adjusting sleeve can be slideable for the purpose of effecting the axial movement on the compressed-air supply line 11 or else can be provided with an internal thread for cooperation with an external thread on the line 11.

Figure 2:
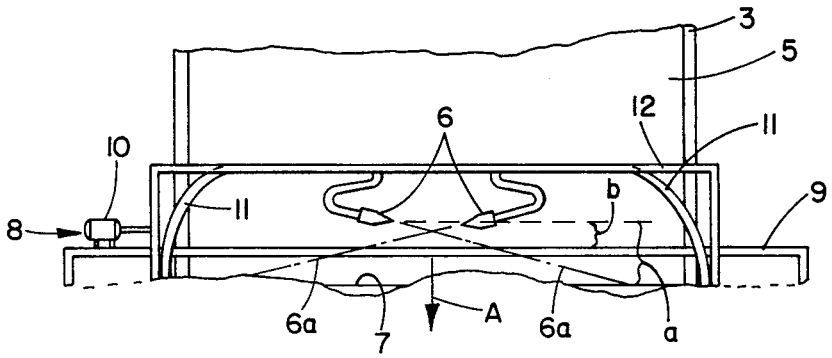
FIG. 2 is a plan view of part of the apparatus of FIG. 1.

In the embodiment of FIGS. 1 and 2, the two air nozzles 6 are directed at one another in such a way that the issuing air jets 6*a* cross one another, both air nozzles 6 being directed towards the suspended web 7. This configuration has the effect of blowing out folds from the middle of the web towards its lateral edges.

In the embodiment of FIG. 3 there is a single air nozzle 6 which is mounted by means of a bearing 18 so that it can be pivoted backwards and forwards in an essentially horizontal plane over a range 17 of approximately 180° and which is directed towards the suspended web 7. The bearing 18 of the air nozzle 6 is supported on a projection 19 arranged on the crossbar 12 of the laying carriage 4. The average distance of the air nozzle 6 from the suspended web 7 or from the transverse track 9 is designated in each case with a and b.

A driving means is connected to the air nozzle 6 for causing the backward-and-forward swinging movement of the air nozzle. The driving means includes drive motor 41, crank 42 and crank arm 43. As drive motor 41 rotates crank 42, the crank arm 43 pivots the nozzle 6. By varying the radial position of crank arm 43 on crank 42, the arc of nozzle 6 may be varied.

The speed at which the nozzle pivots may also be varied by varying the speed of drive motor 41 with potentiometer 44. In a preferred embodiment, potentiometer 41 may be coupled directly to regulating unit 45 to vary the pivotol speed of the nozzle as the speed of the laying leverage is varied. Alternately, other means, such as a mechanical cam means may be provided to couple the movement of the laying carriage to the pivoting nozzle. The driving means can be controlled to swing the air nozzle 6 backwards and forwards more quickly when the travelling speed of the laying carriage 4 is increased and more slowly when the travelling speed of the laying carriage is reduced. The driving motor 41 can be a compressed-air or electric motor, operating according to the princlple of a windscreen wiper motor, for example, a direct current windscreen wiper motor.

In place of the single swingable air nozzle 6, represented in FIG. 3, there can also be arranged two or more air nozzles, for example parallel or at an acute angle to one another.

I claim:

1. An apparatus for laying soft thin fabric, such as nylon, woven goods, jersey, plush weave or the like on a flat laying surface for cutting, said apparatus comprising:

(a) a laying surface for receiving layers of fabric, (b) a laying carriage which is moveable over the laying surface to deposit the fabric on the laying surface, the carriage having means to provide the fabric as a vertically suspended web from the laying carriage to the laying surface, (c) at least one pivoting air nozzle mounted on the laying carriage at the end of a flexible air supply line for directing air in a horizontal plane at the decending web material, said pivoting nozzle being pivotal over an angular range of approximately 180°, (d) a mounting means for suspending the nozzle behind the suspended web with respect to the travel direction of the laying carriage during the laying of the fabric.

(e) means for pivoting the nozzle during the depositing travel of the laying carriage and thereby vary the angular speed of the nozzle as the speed of the laying carriage is varied.

2. Apparatus as claimed in claim 1, wherein the distance between the suspended web and the nozzle is in the range 40 cm to 60 cm.

3. Apparatus as claimed in claim 1, further comprising a transverse cutter mounted on the laying carriage for separating material laid on the laying surface from the suspended web, wherein the distance between the nozzle and the transverse cutter is in the range 20 cm to 60 cm.

4. Apparatus as claimed in claim 3, wherein the distance between the nozzle and the transverse cutter is in the range 30 cm to 50 cm.

5. Apparatus as claimed in claim 3, wherein the transverse cutter comprises a transverse track mounted on the laying carriage, and a cutter element which is displaceable along the track, the distance between the track and the nozzle being in the range 20 cm to 60 cm.

6. Apparatus as claimed in claim 5, wherein the distance between the nozzle and the track is in the range 30 cm to 50 cm.

7. Apparatus as claimed in claim 1, wherein the position of the nozzle is adjustable in the direction towards and away from the suspended web and/or in the vertical direction and/or in the direction transverse of the travel direction of the laying carriage.

8. Apparatus as claimed in claim 1, further comprising a crossbar provided on the laying carriage at a position behind the suspended web, with respect to the travel direction of the laying carriage during deposition of the material, the air supply line being mounted on the crossbar.

9. Apparatus as claimed in claim 8, wherein the crossbar is made from light material.

10. Apparatus as claimed in claim 1, further comprising a source of compressed air provided on the laying carriage, the source of compressed air being connected to the air supply line.

11. Apparatus as claimed in claim 10, wherein a control member is provided on the source of compressed air for regulating the flow of air to the nozzle.

12. Apparatus as claimed in claim 1, wherein means is provided for adjusting the intensity of the blast of air issuing from the nozzle.

13. Apparatus as claimed in claim 12, wherein the adjustment means is provided in the air supply line.

14. Apparatus as claimed in claim 13, wherein the adjustment means comprises an adjusting sleeve surrounding the air supply line, and an opening in the wall of the air supply line, the adjusting sleeve being axially displaceable along the air supply line to open or close part or all of the opening.

15. Apparatus as claimed in claim 1, wherein the nozzle is pivotable over an angular range of approximately 180° C.

16. Apparatus as claimed in claim 15, wherein the nozzle is directed towards the suspended web over its range of pivotal movement.

17. Apparatus as claimed in claim 1, wherein the mounting means is further defined as:

a projection of the laying carriage, and includes a pivotal bearing mounted on the projection for supporting this nozzle.

18. Apparatus as claimed in claim 17, which further comprises a crossbar on the laying carriage, the projection being provided on the crossbar.

19. Apparatus as claimed in claim 1, wherein the drive means comprises an electric or compressed air motor of the windscreen wiper type.

20. Apparatus as claimed in claim 1, wherein the nozzle is one of at least two nozzles.

21. Apparatus as claimed in claim 20, wherein the air jets from the nozzles cross each other.

22. Apparatus as claimed in claim 20, in which both of the nozzles are directed towards the suspended web.

23. Apparatus as claimed in claim 1, wherein the laying carriage is provided with support means for supporting a supply of the web material.

* * * * *